US009518463B2

(12) United States Patent
Hedges et al.

(10) Patent No.: US 9,518,463 B2
(45) Date of Patent: Dec. 13, 2016

(54) CORE CAPTURE AND RECOVERY FROM UNCONSOLIDATED OR FRIABLE FORMATIONS AND METHODS OF USE

(75) Inventors: James H. Hedges, Bartlesville, OK (US); David H. Beardmore, Missouri City, TX (US)

(73) Assignee: ConocoPhillips Company, Houston, TX (US)

( * ) Notice: Subject to any disclaimer, the term of this patent is extended or adjusted under 35 U.S.C. 154(b) by 831 days.

(21) Appl. No.: 13/526,639

(22) Filed: Jun. 19, 2012

(65) Prior Publication Data

US 2012/0325559 A1 Dec. 27, 2012

Related U.S. Application Data

(60) Provisional application No. 61/499,826, filed on Jun. 22, 2011.

(51) Int. Cl.

| | |
|---|---|
| ***E21B 49/00*** | (2006.01) |
| ***E21B 7/00*** | (2006.01) |
| ***E21B 49/02*** | (2006.01) |
| ***E21B 21/00*** | (2006.01) |

(52) U.S. Cl.
CPC ..... *E21B 49/02* (2013.01); *E21B 21/003* (2013.01)

(58) Field of Classification Search
CPC ..... E21B 49/02; E21B 49/00
USPC ..... 175/58, 65, 226, 244, 403, 72
See application file for complete search history.

(56) References Cited

U.S. PATENT DOCUMENTS

| | | | | |
|---|---|---|---|---|
| 3,112,799 | A * | 12/1963 | Gallus | 175/58 |
| 3,621,924 | A * | 11/1971 | Lebourg | 175/58 |
| 3,934,455 | A | 1/1976 | Harrisberger | |
| 3,998,269 | A | 12/1976 | Lybarger | |
| 4,014,393 | A * | 3/1977 | Hensel, Jr. | 175/58 |
| 4,158,521 | A | 6/1979 | Anderson et al. | |
| 4,247,403 | A * | 1/1981 | Foley et al. | 175/72 |
| 4,526,240 | A * | 7/1985 | McKinley et al. | 175/72 |

(Continued)

OTHER PUBLICATIONS

PCT/US2012/043145 PCT International Search Report (PCT/ISA/220) Dated Aug. 30, 2012.

(Continued)

*Primary Examiner* — Blake Michener
*Assistant Examiner* — Michael Wills, III
(74) *Attorney, Agent, or Firm* — ConocoPhillips Company

(57) ABSTRACT

Methods and systems for enhanced capture and recovery of core samples from unconsolidated or friable formations are provided using drilling fluids that permit increased overpressures to preserve the ability to cut core samples and to strengthen the core samples obtained. Drilling fluids used during capture and recovery of core samples may comprise a solid particulate loss prevention material having a size range from about 150 microns to about 1,000 microns. The solid particulate loss prevention material prevents fracture initiation and propagation in the subterranean formation to allow the use of higher overpressures than would otherwise be possible. Thus, by circulating drilling fluid in the borehole while drilling a core sample, higher overpressures may be achieved, which have been found to be beneficial during core capture and recovery by maintaining core integrity and avoiding core loss. In this way, core sample integrity is improved, yielding more accurate representations of the subsurface.

14 Claims, 1 Drawing Sheet

(56) References Cited

U.S. PATENT DOCUMENTS

| | | | | |
|---|---|---|---|---|
| 4,799,549 | A | 1/1989 | Vinot et al. | |
| 4,828,726 | A | 5/1989 | Himes et al. | |
| 4,848,487 | A * | 7/1989 | Anderson et al. | 175/58 |
| 5,180,020 | A | 1/1993 | Fuh et al. | |
| 5,197,544 | A | 3/1993 | Himes | |
| 5,207,282 | A | 5/1993 | Fuh et al. | |
| 5,431,225 | A | 7/1995 | Abass et al. | |
| 5,484,028 | A | 1/1996 | Rose | |
| 5,560,438 | A * | 10/1996 | Collee et al. | 175/58 |
| 5,801,127 | A | 9/1998 | Duhon, Sr. | |
| 5,981,447 | A | 11/1999 | Chang et al. | |
| 6,399,545 | B1 | 6/2002 | Rose | |
| 7,452,849 | B2 * | 11/2008 | Berry et al. | 507/127 |
| 7,530,408 | B2 | 5/2009 | Cambus-Brunet et al. | |
| 7,546,873 | B2 | 6/2009 | Kim et al. | |
| 7,703,513 | B2 | 4/2010 | Vinegar et al. | |
| 7,861,609 | B2 | 1/2011 | Haggerty et al. | |
| 7,934,569 | B2 | 5/2011 | Garcia et al. | |
| 2009/0241700 | A1 | 10/2009 | Haggerty et al. | |
| 2010/0230164 | A1 * | 9/2010 | Pomerleau | 175/40 |
| 2010/0230169 | A1 * | 9/2010 | Pomerleau | 175/72 |
| 2012/0037427 | A1 * | 2/2012 | Kinsella | 175/58 |

OTHER PUBLICATIONS

Swatzell et al. "Frozen Soil Barrier Technology" U.S. Dept. of Energy, Innovative Technology Summary Report, Apr., 32 pp. (1995).

McElwee, et al., "A New Sampling System for Obtaining Relatively Undisturbed Samples of Unconsolidated Coarse Sand and Gravel," Ground Water Monitoring & Remediation, 11:182-191 (2007).

Rosen, et al., "Recent Experience with Unconsolidated Core Analysis" Society of Core Analysts, Calgary, Canada, (Sep. 10-12, 2007).

* cited by examiner

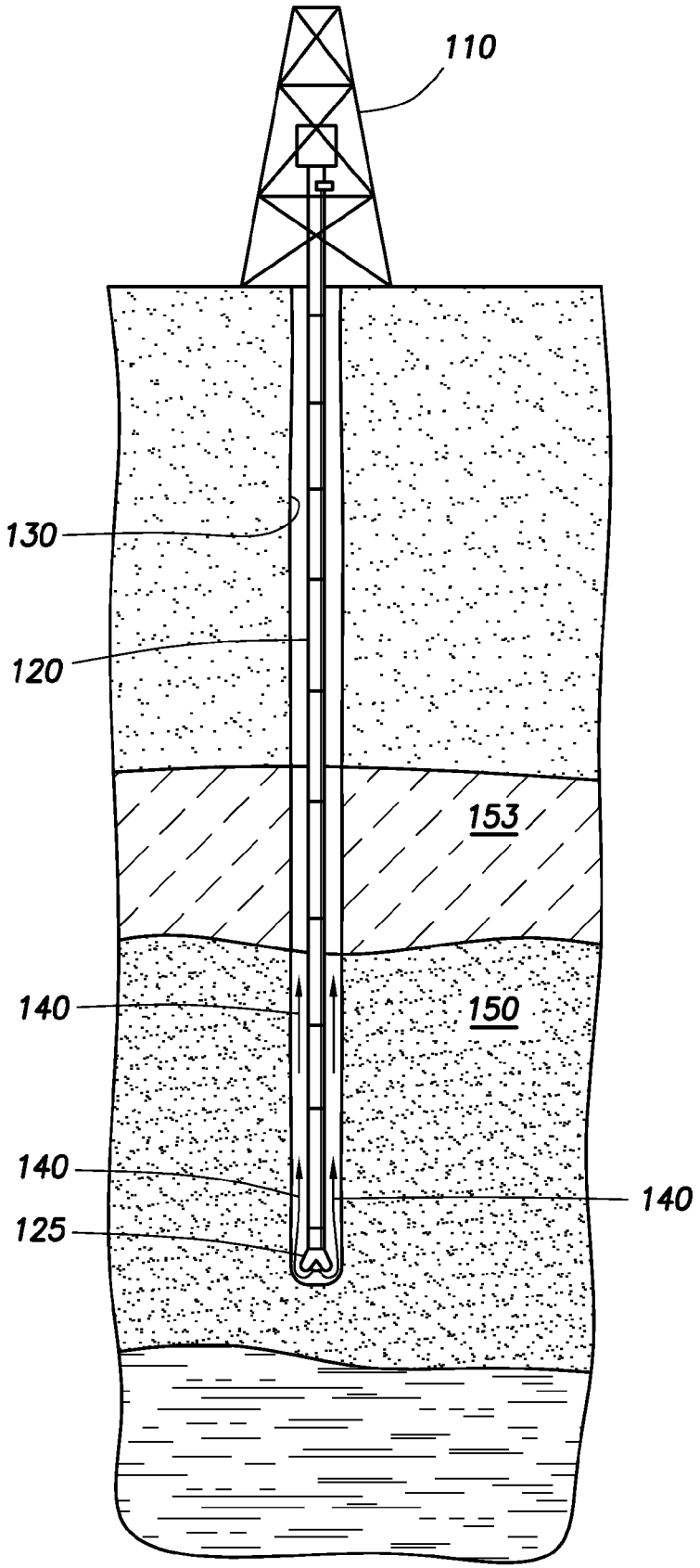
110
130
120
153
140
150
140
140
125

CORE CAPTURE AND RECOVERY FROM UNCONSOLIDATED OR FRIABLE FORMATIONS AND METHODS OF USE

CROSS-REFERENCE TO RELATED APPLICATIONS

This application is a non-provisional application which claims benefit under 35 USC §119(e) to U.S. Provisional Application Ser. No. 61/499,826 filed Jun. 22, 2011, entitled "Improved Core Capture and Recovery from Unconsolidated or Friable Formations and Methods of Use," which is incorporated herein in its entirety.

STATEMENT REGARDING FEDERALLY SPONSORED RESEARCH

None.

FIELD OF THE INVENTION

The present invention relates generally to methods and systems for enhanced capture and recovery of core samples from unconsolidated or friable formations. More particularly, but not by way of limitation, embodiments of the present invention include methods and systems for enhanced core sample capture and recovery using drilling fluids that permit increased overpressures to increase rock strength and improve core recovery.

BACKGROUND

Geologists and engineers often evaluate subterranean formations for the purpose of improving hydrocarbon recovery. Once a formation of interest is located, one way of studying the formation is by obtaining and analyzing representative samples of rock. The representative samples are generally cored from the formation using a core drill or other core capture device. Formation samples obtained by this method are generally referred to as core samples. Analysis of core samples is generally regarded as the most accurate method for evaluating the characteristics of a formation and how the reservoir fluids (e.g. oil, brine, and gas) interact therein. Although many types of core sampling exist (e.g. rotary and percussion side-wall coring, cuttings, etc), being able to cut a conventional whole core provides the largest amount of core leading to the largest plug samples to test (improved accuracy with improved plug pore volume, etc.) and the largest continuous resource for geologic analysis.

Once the core sample has been transported to the surface, the core sample is analyzed to evaluate the reservoir characteristics, such as porosity, permeability, relative permeability, capillary pressure, wettability, lithology, etc. The analysis of the core sample is then used to plan and implement a well completion and production strategy and design. For example, analysis of core samples may reveal information useful for determining from which intervals to produce hydrocarbons or which intervals to stimulate or otherwise treat.

Unconsolidated and friable formations present significant challenges to recovering undamaged or useful core samples. Unconsolidated material is material with insufficient cementing agents between the grains to stop movement of individual grains during coring or handling, having compressive strengths less than about 10 psi. In other words, the term "unconsolidated" refers to loose or not stratified grains such as is the case with uncompacted, free flowing sand.

Friable material, on the other hand, refers to material that is easily broken into small fragments or reduced to individual sand grains.

A common problem shared by unconsolidated and/or friable formations is the susceptibility of these formations to wash away from the mud flow at the coring bit or jam within the core liner during the core capture and retrieval process. In some cases, the core sample may not possess sufficient compressive strength to support the weight of the column of core sample already captured, or the core sample may simply fluidize or "wash out" during the core drilling process. Whatever the mechanism of core loss, core loss remains a significant problem in unconsolidated and friable formations. This problem is so significant that in many cases, no useful core sample is retrieved due to the severity of problems encountered while capturing and retrieving core samples. Indeed, it has been estimated that approximately 20% of core samples are lost in the United States and Canada due to the inability to core and or core damage.

The problem of obtaining useful cores is further exacerbated in deviated and horizontal wells due to the fact that as the deviation of a wellbore increases, the core becomes less self-supporting and more susceptible to inner tube friction and vibrations during entry.

Various conventional solutions have been proposed to mitigate the problem of core sample recovery and damage. In particular, many mechanical solutions have been proposed such as using low invasion coring bits to reduce the probability of fluidizing the core. This mechanical enhancement has enjoyed limited success in truly unconsolidated or friable formations.

In some cases, operators have resorted to capturing and recovering core samples in short segments to avoid core collapse. Even when this technique happens to work, however, it is expensive and costly in terms of the extra well bore trips required to sequentially recover the multiple core samples. With daily rig rates varying from $20,000 to $1 million dollars, any increase in time spent capturing and recovering core samples can be prohibitively expensive.

Additionally, a variety of remedial measures exist to mitigate the adverse effects of core damage. As one might imagine, however, remedial measures are far less effective at mitigating the adverse effects of core damage than successful preventative measures.

Accordingly, there is a need for enhanced core capture and recovery methods that address one or more of the disadvantages of the prior art.

SUMMARY

The present invention relates generally to methods and systems for enhanced capture and recovery of core samples from unconsolidated or friable formations. More particularly, but not by way of limitation, embodiments of the present invention include methods and systems for enhanced core sample capture and recovery using drilling fluids that permit increased overpressures to increase rock strength and improve core recovery.

One example of a method for obtaining a core sample from a friable or unconsolidated formation comprises the steps of: drilling a core sample from a borehole that intersects the friable or unconsolidated formation; circulating a drilling fluid in the borehole while drilling the core sample, wherein the drilling fluid comprises a solid particulate loss prevention material having a size range substantially from about 250 microns to about 600 microns, such that the solid particulate loss prevention material is adapted to mitigate fracture initiation and propagation in the friable or unconsolidated formation or in a subterranean zone adjacent to or above the friable or unconsolidated formation; maintaining an overpressure of at least about 300 psi; and capturing and recovering the core sample from the unconsolidated formation.

One example of a method for obtaining a core sample from a friable or unconsolidated formation comprises the steps of: drilling a core sample from a borehole that intersects the friable or unconsolidated formation; circulating a drilling fluid in the borehole while drilling the core sample, wherein the drilling fluid comprises a solid particulate loss prevention material having an average size range from about 150 microns to about 1,000 microns; maintaining an overpressure of at least about 200 psi; and capturing and recovering the core sample from the unconsolidated formation.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein:

FIG. 1 illustrates an example of a core capture and recovery system in accordance with one embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The present invention relates generally to methods and systems for enhanced capture and recovery of core samples from unconsolidated or friable formations. More particularly, but not by way of limitation, embodiments of the present invention include methods and systems for enhanced core sample capture and recovery using drilling fluids that permit increased overpressures to increase rock strength and improve core recovery.

In certain embodiments, a drilling fluid is circulated in a borehole while drilling a core sample in a friable or unconsolidated formation. The drilling fluid may comprise a solid particulate loss prevention material having an average size range from about 150 microns to about 1,000 microns. The solid particulate loss prevention material may act to prevent fracture initiation and propagation in the subterranean formation to allow higher overpressures than would otherwise be possible. For the reasons explained below, higher overpressures are beneficial during the friable to unconsolidated core capture and/or recovery process to maintain core integrity and avoid core loss. In this way, core sample integrity is improved, yielding more accurate representations of the subsurface.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the invention.

FIG. 1 illustrates an example of a core capture and recovery system in accordance with one embodiment of the present invention. Drilling rig 110 is provided for actuating drill pipe 120 with core drill bit 125 for recovery of a core sample from unconsolidated or friable formation 150. During drilling of borehole 130, a drilling fluid 140 is circulated from drill pipe 120 through the annulus formed between drill pipe 120 and borehole 130. The drilling fluid may comprise a solid particulate loss prevention material. The solid particulate loss prevention material through several beneficial mechanisms which will be explained further below, allow higher overpressures to be used during drilling, which in turn enhances core capture and recovery. In this way, core samples having improved core integrity may be captured and recovered from unconsolidated or friable formation 150.

As described previously, unconsolidated and friable formations present significant challenges when attempting to recover core samples from these formations. Often, unconsolidated and friable formations lack sufficient compressive strength to maintain core integrity during the core capture and recovery process, especially for core sample lengths exceeding about 10 to about 12 feet. In many cases, extracting useful core lengths of any length is difficult, if not impossible, using conventional methods.

One way to improve the structural integrity of the cored formation is by increasing the overpressure in the wellbore with a drilling fluid or other treating fluid. Overpressure is the wellbore pressure that exceeds the reservoir pore pressure at a given depth. Increasing the overpressure around the core sample reduces the risk of core collapse and loss by a variety of mechanisms. The amount of overpressure that may be applied in the wellbore (strengthen the formation at the drill bit surface and to strengthen any newly cut core) is however limited by the fracture gradient or fracture pressure of the formation (or that of an adjacent subterranean zone, e.g. adjacent zone 153). Unfortunately, in many unconsolidated and friable formations, the fracture pressure of the formation (or that of an adjacent subterranean zone) is fairly low such that the overpressure around the core sample cannot be substantially increased without encountering a sudden fluid loss problem. That is, increasing the overpressure in the formation will at some point result in the initiation and propagation of fractures into the unconsolidated or friable formation (or in an adjacent subterranean zone) such that the drilling or treating fluid is lost from the wellbore, which in turn causes a sudden loss of pressure. The inability to maintain pressure in the wellbore not only presents serious well control issues, but also fails to provide the desired structural integrity support to the core sample.

Accordingly, it is desired to raise the permissible overpressure in the wellbore and the formation. One way of increasing the permissible overpressure is by circulating a drilling fluid that is adapted to mitigate fracture initiation and propagation, that is, a drilling fluid that raises the fracture gradient or fracture pressure. In certain embodiments, the drilling fluid comprises a solid particulate loss prevention material that increases the fracture initiation and propagation pressure. The solid particulate loss prevention material may comprise solid particulates that act to "screen out" at the tip of an incipient or existing fracture to prevent fracture initiation and propagation in the cored interval. In other cases, the solid particulates may mitigate fractures initiation and propagation in an adjacent subterranean zone such as an overlying rock structure.

In certain embodiments, the solid particulate loss prevention material comprises particulates ranging in size from 140 mesh (about 100 microns) to 18 mesh (about 1,000 microns). In other embodiments, the particulates of the solid particulate loss prevention material range from about 250 microns to about 600 microns or from about 30 mesh to about 60 mesh, or any combination thereof where a specific mesh size corresponds to the number of particles that are retained, or pass through, a particular pore size. Typically a mesh size "less than" indicates that greater than 75 percent, 80 percent, 90 percent or 95 percent of the particles will pass through a corresponding pore size. For example an 18 mesh corresponds to about 1000 microns, 20 mesh is approximately 840 microns, 25 mesh is approximately 700 microns, 30 mesh is approximately 600 microns, 35 mesh is approximately 500 microns, 40 mesh is approximately 420 microns, 45 mesh is approximately 350 microns, 50 mesh is approximately 300 microns, 60 mesh is approximately 250 microns, 70 mesh is approximately 210 microns, 80 mesh is approximately 180 microns, 100 mesh is approximately 150 microns, 120 mesh is approximately 125 microns, and 140 mesh is approximately 100 microns. Mesh sizes may be bounded where a specific material between 20 mesh (~840 microns) and 60 mesh (~250 microns) would consist of a variety of particles that pass through a 20 mesh screen, particles smaller than 840 microns and be retained by a 60 mesh screen, particles larger than 250 microns. In one embodiment particles are provided between 20 mesh and 60 mesh, in another embodiment particles are provided between 18 mesh and 140 mesh.

In another embodiment particles are provided with an average particle size. Where a single particle size is given the majority of the particles are approximately the given size, this can very by standard deviations, percentage, ability to screen or other criteria dependent upon the material and how it was produced. Particles may be provided that are 18 mesh, 20 mesh, 25 mesh, 30 mesh, 35 mesh, 40 mesh, 50 mesh, 55 mesh, 60 mesh, 65 mesh, 70 mesh, 75 mesh, 80 mesh, 85 mesh, 90 mesh, 95 mesh, 100 mesh, 110 mesh, 120 mesh, 130 mesh, or 140 mesh.

The solid particulate loss prevention material may comprise any material suitable for increasing the potential overpressure around the core area. Examples of suitable solid particulate loss prevention materials include, but are not limited to, petroleum coke, calcined petroleum coke, gilsonite, calcium carbonate, glass, ceramics, polymeric beads, nut shells, or any combination thereof. The solid particulate loss prevention material may include any of the solid particulate loss prevention materials described in U.S. Pat. No. 5,207,282, filed on Oct. 5, 1992, which is hereby incorporated by reference.

Generally, the solid particulate loss prevention material may comprise materials in a solid state having a well-defined physical shape as well as those with irregular geometries, including, but not limited to, any particulates having the physical shape of spheroids, hollow beads, pellets, tablets, isometric, angular, or any combination thereof.

Thus, circulating a drilling fluid that comprises a solid particulate loss prevention material has the beneficial effect of allowing a higher overpressure to be used. The higher overpressure improves the core integrity by a variety of mechanisms. First, the higher overpressure compacts the core, which adds structural integrity to the core sample. Additionally, the higher overpressure along with use of the solid particulate loss prevention material promotes a coating or layer that surrounds or otherwise encapsulates the core sample. This coating or layer is formed from a compacted solid or semisolid material that deposits itself around the core sample during the circulation of the drilling fluid. This mud cake also acts to add structural integrity to the core sample by coating the core with an encapsulating support layer of mud cake. Whatever the mechanism for increasing the structural integrity of the core sample, however, it is observed that increasing the overpressure results in a substantial increase to the structural integrity of a core sample.

In certain embodiments, the overpressure realized from circulation of the solid particulate loss prevention material includes overpressures of up to about 1200 psi, including overpressures from about 200 psi to about 600 psi, from about 300 psi to about 500 psi, from about 600 psi to about 1200 psi, at least about 200 psi, 300 psi, 400 psi, 500 psi, 600 psi, 700 psi, 800 psi, 900 psi, 1000 psi, 1100 psi, 1200 psi or any combination thereof.

Certain embodiments of the present invention may vary the concentration (in pounds per barrel of drilling fluid) of the solid particulate loss prevention material in the drilling fluid to within about ±20% of that determined by the equation $C=SG(3.5\ MW-14.0)$, wherein C is the concentration in pounds per barrel of drilling fluid of the solid particulate loss prevention material in the drilling fluid, wherein SG is a specific gravity of the loss prevention material, and wherein MW is a mud weight of the drilling fluid (in pounds per gallon). In still other embodiments, the concentration may be determined by the equation $C \geq 12.3\ SG$. In certain embodiments, suitable concentrations may include, but are not limited to, pounds per barrel (ppb) from about 2 ppb to about 150 ppb or from about 20 ppb to about 80 ppb, depending on the identity and characteristics of the solid particulate loss prevention material and other components of the drilling fluid. In another embodiment, suitable concentrations include approximately 2 ppb, 2.5 ppb, 5 ppb, 7.5 ppb, 10 ppb, 15 ppb, 20 ppb, 25 ppb, 30 ppb, 50 ppb, 75 ppb, 80 ppb, 100 ppb, 125 ppb, or 150 ppb dependent upon the specific gravity of the loss prevention material and the mud weight of the drilling fluid. Lighter loss prevention materials like nut hulls (1.3 sp gr) may be used at a much lower ppb than more dense loss prevention materials like $CaCO_3$ (2.6 sp gr). Other measures of concentration frequently used include pounds per gallon (ppg) where 1 ppg=42 ppb and weight percent where 1 wt %=3.4 ppb for materials with a specific gravity of one.

Thus, one example of a method of the present invention comprises the steps of: drilling a core sample in a friable or unconsolidated formation; circulating a drilling fluid in the borehole while drilling the core sample, wherein the drilling fluid comprises the solid particulate loss prevention material; maintaining an increased overpressure; and recovering the core sample from the unconsolidated formation. In certain embodiments, the step of maintaining the increased overpressure may be simultaneous with one or more of the other steps (e.g. drilling, circulating, and recovering).

In certain embodiments, the rate of penetration of the core drill during the step of drilling is limited to a rate that effectively cuts the core sample and avoids fluidizing, "washing away" the core sample, or otherwise damaging the core sample during the core capture process. Additionally, the flow rate of drilling fluid may also be controlled to further limit washing away the core sample. Suitable limited drilling fluid circulation flow rates include, but are not limited to, flow rates less than about 150 gpm. In certain embodiments, it may be preferred to capture core samples at larger diameters. Suitable core diameters include, but are not limited to, diameters from about 4 inches to about 5¼ inches.

Because deviated wells have a lower wellbore breakdown pressure, the methods of the present invention are particularly beneficial as applied to deviated wells. Accordingly, certain embodiments of the present invention apply the methods herein to deviated wells, including particularly wells deviated more than 40 degrees from the vertical, including horizontal wells.

Without the methods described herein, capturing and recovering core samples of any length may be difficult or impossible in some unconsolidated or friable formations. In some formations, undamaged core lengths of no more than about 10 feet to about 12 feet may be recoverable at a time. In such instances, applying methods of the present invention may achieve core lengths as long as about 20 feet to about 30 feet without substantial damage to the core sample.

It is explicitly recognized that any of the elements and features of each of the devices described herein are capable of use with any of the other devices described herein with no limitation. Furthermore, it is explicitly recognized that the steps of the methods herein may be performed in any order except unless explicitly stated otherwise or inherently required otherwise by the particular method.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations and equivalents are considered within the scope and spirit of the present invention. Also, the terms in the claims have their plain, ordinary meaning unless otherwise explicitly and clearly defined by the patentee.

The invention claimed is:

1. A method for obtaining a core sample from a friable or unconsolidated formation comprising the steps of:

drilling a core sample from a borehole that intersects the friable or unconsolidated formation;

circulating a drilling fluid in the borehole while drilling the core sample, wherein the drilling fluid comprises a solid particulate loss prevention material having an average size range from 100 mesh (about 150 microns) to 18 mesh (about 1,000 microns); maintaining an overpressure of at least about 200 psi to about 1200 psi; capturing and recovering the core sample from the unconsolidated formation; wherein the step of maintaining the overpressure is performed during the steps of drilling the core sample, circulating the drilling fluid, and recovering the core sample; wherein the step of drilling is limited to a rate of penetration of a rate less than that which would fluidize the core sample at the overpressure; and wherein the step of circulating further comprises the step of circulating a drilling fluid in the borehole at a flow rate of less than about 150 gpm.

2. The method of claim 1 wherein the solid particulate loss prevention material:

has an average size of from about 250 microns to about 600 microns including about 300 microns, about 350 microns, about 400 microns, about 450 microns, about 500 microns, about 550 microns and about 600 microns;

is at least 75 percent by weight in a size range of from 60 mesh (about 250 microns) to 30 mesh (about 600 microns) including 50 mesh (about 300 microns), 45 mesh (about 350 microns), 40 mesh (about 400 microns), about 450 microns, 35 mesh (about 500 microns), about 550 microns and 30 mesh (about 600 microns);

is petroleum coke, gilsonite, calcium carbonate, glass, ceramic, plastic, nut shells, or any combination thereof; and is formed substantially in the shape of spheroids, hollow beads, pellets, tablets, an isometric shape, an angular shape, or any combination thereof.

3. The method of claim 1 wherein the borehole is a deviated borehole including boreholes at an angle greater than about 20 degrees, about 30 degrees, about 40 degrees, about 50 degrees, about 60 degrees, about 70 degrees, about 80 degrees from vertical or nearly horizontal.

4. The method of claim 1 wherein the drilling fluid has a concentration of solid particulates from about 2 pounds per barrel (ppb) to 150 ppb, including approximately 2 ppb, 2.5 ppb, 3.4 ppb, 5 ppb, 7.5 ppb, 10 ppb, 15 ppb, 20 ppb, 25 ppb, 30 ppb, 34 ppb, 42 ppb, 50 ppb, 75 ppb, 80 ppb, 100 ppb, 125 ppb, or 150 ppb dependent upon the specific gravity of the loss prevention material and the mud weight of the drilling fluid.

5. The method of claim 1:

wherein the core sample extends in one continuous segment of greater than 10 feet including approximately 10 feet, 15 feet, 20 feet, 25 feet, 30 feet, 35 feet, from about 10 feet to about 35 feet, from about 15 feet to about 30 feet; and wherein the diameter of the core sample is about 2 inches to about 6 inches including about 2 to 2⅞ inches, about 3 to 3⅞ inches, about 4 to 4⅞ inches, about 5 to 5⅞ inches, about 2¼ inches, about 2½ inches, about 2¾ inches, about 3¼ inches, about 3½ inches, about 3¾ inches, about 4¼ inches, about 4½ inches, about 4¾ inches, about 5 inches, about 5¼ inches, about 5½ inches, about 5¾ inches, to about 6 inches.

6. The method of claim 1:

wherein the loss prevention material is at least 75 percent by weight in a size range of from 60 mesh (about 250 microns) to 30 mesh (about 600 microns);

wherein the loss prevention material is calcined petroleum coke, calcium carbonate, nut hulls, or any combination thereof;

wherein the drilling fluid has a concentration of about 2 to about 150 pounds of solid particulates per barrel of drilling fluid;

wherein the core sample extends in one continuous segment of from about 15 feet to about 30 feet;

wherein the core sample has a diameter and wherein the diameter of the core sample is about 2 inches to about 6 inches; and wherein the overpressure is from about 300 psi to about 1200 psi.

7. The method of claim 1:

wherein the solid particulate loss prevention material has an average size of from 60 mesh (about 250 microns) to 30 mesh (about 600 microns);

wherein the core sample extends in one continuous segment of from about 10 feet to about 35 feet; and wherein the core sample has a diameter and wherein the diameter of the core sample is about 2 inches to about 6 inches.

8. A method for obtaining a core sample from a friable or unconsolidated formation comprising the steps of:

drilling a core sample from a borehole that intersects the friable or unconsolidated formation, wherein the core sample extends in one continuous segment of from about 10 feet to about 35 feet, wherein the core sample has a diameter and wherein the diameter of the core sample is about 2 inches to about 6 inches; circulating a drilling fluid in the borehole while drilling the core sample, wherein the drilling fluid comprises a solid particulate loss prevention material having an average size of from 60 mesh (about 250 microns) to 30 mesh (about 600 microns), such that the solid particulate loss prevention material is adapted to mitigate fracture initiation and propagation in the friable or unconsolidated formation or in a subterranean zone adjacent to or above the friable or unconsolidated formation; maintaining an overpressure of at least about 200 psi to about 1200 psi; and capturing and recovering the core sample from the unconsolidated formation; wherein the step of maintaining the overpressure is performed during the steps of drilling the core sample, circulating the drilling fluid, and recovering the core sample.

9. The method of claim 8 wherein the solid particulate loss prevention material:

has an average size of from about 250 microns to about 600 microns including about 300 microns, about 350 microns, about 400 microns, about 450 microns, about 500 microns, about 550 microns and about 600 microns;

is at least 75 percent by weight in a size range of from 60 mesh (about 250 microns) to 30 mesh (about 600 microns) including 50 mesh (about 300 microns), 45 mesh (about 350 microns), 40 mesh (about 400 microns), about 450 microns, 35 mesh (about 500 microns), about 550 microns and 30 mesh (about 600 microns);

is petroleum coke, gilsonite, calcium carbonate, glass, ceramic, plastic, nut shells, or any combination thereof; and is formed substantially in the shape of spheroids, hollow beads, pellets, tablets, an isometric shape, an angular shape, or any combination thereof.

10. The method of claim 8 wherein the borehole is a deviated borehole including boreholes at an angle greater than about 20 degrees, about 30 degrees, about 40 degrees, about 50 degrees, about 60 degrees, about 70 degrees, about 80 degrees from vertical or nearly horizontal.

11. The method of claim 8 wherein the drilling fluid has a concentration of solid particulates from about 2 pounds per barrel (ppb) to 150 ppb, including approximately 2 ppb, 2.5 ppb, 3.4 ppb, 5 ppb, 7.5 ppb, 10 ppb, 15 ppb, 20 ppb, 25 ppb, 30 ppb, 34 ppb, 42 ppb, 50 ppb, 75 ppb, 80 ppb, 100 ppb, 125 ppb, or 150 ppb dependent upon the specific gravity of the loss prevention material and the mud weight of the drilling fluid.

12. The method of claim 8:

wherein the core sample extends in one continuous segment of greater than 10 feet including approximately 10 feet, 15 feet, 20 feet, 25 feet, 30 feet, 35 feet, from about 10 feet to about 35 feet, from about 15 feet to about 30 feet; and wherein the diameter of the core sample is about 2 inches to about 6 inches including about 2 to 2⅞ inches, about 3 to 3⅞ inches, about 4 to 4⅞ inches, about 5 to 5⅞ inches, about 2¼ inches, about 2½ inches, about 2¾ inches, about 3¼ inches, about 3½ inches, about 3¾ inches, about 4¼ inches, about 4½ inches, about 4¾ inches, about 5 inches, about 5¼ inches, about 5½ inches, about 5¾ inches, to about 6 inches.

13. The method of claim 8:

wherein the step of drilling is limited to a rate of penetration of a rate less than that which would fluidize the core sample at the overpressure; and wherein the step of circulating further comprises the step of circulating a drilling fluid in the borehole at a flow rate of less than about 150 gpm.

14. The method of claim 8:

wherein the loss prevention material is at least 75 percent by weight in a size range of from 60 mesh (about 250 microns) to 30 mesh (about 600 microns);

wherein the loss prevention material is calcined petroleum coke, calcium carbonate, nut hulls, or any combination thereof;

wherein the drilling fluid has a concentration of about 2 to about 150 pounds of solid particulates per barrel of drilling fluid;

wherein the core sample extends in one continuous segment of from about 15 feet to about 30 feet;

wherein the core sample has a diameter and wherein the diameter of the core sample is about 2 inches to about 6 inches; and wherein the overpressure is from about 300 psi to about 1200 psi.

* * * * *